US006915846B2

(12) United States Patent
Carriere

(10) Patent No.: US 6,915,846 B2
(45) Date of Patent: Jul. 12, 2005

(54) PRODUCTION TUBING JOINT

(76) Inventor: Kent J. Carriere, P.O. Box 433, Lloydminster, Saskatchewan (CA), S9V 0Y4

( * ) Notice: Subject to any disclaimer, the term of this patent is extended or adjusted under 35 U.S.C. 154(b) by 204 days.

(21) Appl. No.: 10/367,778

(22) Filed: Feb. 19, 2003

(65) Prior Publication Data

US 2004/0000404 A1 Jan. 1, 2004

(51) Int. Cl.[7] ..... E21B 23/00
(52) U.S. Cl. ..... 166/208; 166/117.7; 166/382
(58) Field of Search ..... 166/208, 117.7, 166/382, 381, 240, 242.1

(56) References Cited

U.S. PATENT DOCUMENTS

| | | | | |
|---|---|---|---|---|
| 2,906,342 A | * | 9/1959 | Anderson et al. | 166/115 |
| 4,440,229 A | * | 4/1984 | Burch | 166/311 |
| 4,519,451 A | * | 5/1985 | Gray et al. | 166/278 |
| 4,921,407 A | * | 5/1990 | Ponder | 417/553 |
| 4,964,460 A | | 10/1990 | Armell et al. | |
| 5,927,403 A | * | 7/1999 | Dallas | 166/77.51 |
| 5,957,198 A | | 9/1999 | Haynes | |
| 6,009,941 A | | 1/2000 | Haynes | |
| 6,019,175 A | | 2/2000 | Haynes | |
| 6,447,021 B1 | * | 9/2002 | Haynes | 285/302 |

FOREIGN PATENT DOCUMENTS

| | | |
|---|---|---|
| CA | 2296195 | 5/2001 |

* cited by examiner

*Primary Examiner*—Frank S. Tsay
(74) *Attorney, Agent, or Firm*—Murray E. Thrift; Aikins Patent Company

(57) ABSTRACT

A production tubing joint is disclosed for a well comprising a barrel forming an upper tubing section and connected to the tubing hanger, a tubing connector within the barrel having a lower end connected to a lower tubing section of the production tubing string, a lower locking means having a first lower lock component secured to the barrel and a second lower lock component secured to the tubing connector and selectively engageable with the first lower lock component for suspending the tubing connector and the lower tubing section from the barrel, an adapter bar for connection to a rod string, and an upper locking means having a first upper lock component secured to the tubing connector and a second upper lock component secured to the adapter bar and selectively engageable with the first upper lock component. When the upper locking means are engaged, the adapter bar may be manipulated to disengage the lower locking means so as to separate the lower tubing section from the barrel and suspend the tubing connector and the lower tubing section from the adapter bar. This enables cleaning out sand from a well bore without unseating the tubing hanger, and the operation can be completed using flushby units rather than a service rig.

8 Claims, 4 Drawing Sheets

PRODUCTION TUBING JOINT

FIELD OF THE INVENTION

The present invention relates to well bore equipment, and more particularly to a tubing joint that enables cleaning out sand from a well bore without unseating the tubing hanger.

BACKGROUND OF THE INVENTION

In settings such as heavy oil wells, sand in the pumps is sometimes a significant problem affecting a well's ability to run properly. The usual solution to this problem is to stop production and call in a service rig to clean out the sand, with the result that the well is off production for a day or possibly two. In a cased well equipped with a well head, tubing strings are supported by and suspended from a tubing hanger, and this equipment must be removed to allow the service rig to complete clean-up operations.

U.S. Pat. No. 5,957,198 to Haynes discloses a telescoping joint for use in locating the downhole tools in a well bore without disconnecting the production tubing from the well head, so a service rig may not be required. The conduit and tool are axially displaced, allowing for downward and upward displacement as necessary to assist in well bore clean-up. However, the focus in Haynes appears to be on a zone-isolating tool, as the problems associated with an appropriate joint structure are only tangentially addressed, with little attention directed to means for locking or otherwise controlling the joint. U.S. Pat. No. 6,019,175 to Haynes discloses a slightly modified arrangement, but the focus there is on a complicated tubing hanger apparatus and fluid pressure concerns rather than an appropriate joint structure.

SUMMARY OF THE INVENTION

What is required is an apparatus that will allow the removal of down-hole sand without requiring a service rig.

According to one aspect of the present invention there is provided a tubing joint for a well including a well bore, a well head at the top of the well bore, and a production tubing string extending along the well bore from the well head, the tubing joint comprising:

a tubing hanger suspending the production tubing string from the well head;

a barrel forming an upper tubing section of the production tubing string and connected to the tubing hanger;

a tubing connector within the barrel and having a lower end connected to a lower tubing section of the production tubing string;

a lower locking means having:

a first lower lock component secured to the barrel; and a second lower lock component secured to the tubing connector and selectively engageable with the first lower lock component, for suspending the tubing connector and the lower tubing section from the barrel;

an adapter bar for connection to a rod string; and an upper locking means having:

a first upper lock component secured to the tubing connector; and a second upper lock component secured to the adapter bar and selectively engageable with the first upper lock component such that with the upper locking means engaged, the adapter bar may be manipulated to disengage the lower locking means so as to separate the lower tubing section from the barrel and suspend the tubing connector and the lower tubing section from the adapter bar.

Preferred embodiments of the present invention include a downhole pump connected to the production tubing string and the rod string along the production tubing string for driving the downhole pump, the adapter bar being adapted for insertion between an upper portion of the rod string and a lower portion of the rod string.

The lower locking means preferably comprise a sub connected to the barrel, a slot in the sub with an upwardly inclined entrance section and an axial locking section, and a pin secured to and projecting laterally from the tubing connector and engageable in the slot. The upper locking means preferably comprise a slot in the tubing connector with a downwardly inclined entrance section and an axial locking section, and a pin secured to and projecting laterally from the adapter bar and engageable in the slot.

A preferred method of flushing a well including a well bore, a well head at the top of the well bore, and a production tubing string extending along the well bore from the well head comprises the steps of:

(a) providing a tubing joint in the production tubing string;

(b) inserting a rod string including an adapter bar into the production tubing string;

(c) attaching the adapter bar to the tubing joint;

(d) manipulating the adapter bar to manipulate the tubing joint and separate the production tubing string into an upper tubing section suspended from the well head and a lower tubing section suspended from the adapter bar;

(e) flushing the production tubing string and the well bore; and (f) manipulating the adapter bar to manipulate the tubing joint and reconnect the upper tubing section suspended from the well head and the lower tubing section suspended from the adapter bar.

In preferred methods, the well includes a downhole pump connected to the production tubing string and the rod string along the production tubing string for driving the downhole pump, and includes the steps of pulling the rod string and inserting the adapter bar between an upper portion of the rod string and a lower portion of the rod string before the step of inserting the rod string into the production tubing string. Preferred methods further include lowering the rod string during the flushing of the production tubing string and the well bore. The adapter bar can be removed from the rod string or left in place after use in disengaging and re-engaging the lower locking means.

As can be seen, the present invention as summarized above provides an apparatus that enables the removal of down-hole sand without requiring tubing hanger dismantling necessitating a service rig. In fact, the present invention provides numerous advantages over the prior art and the apparatuses currently in use. In particular, the present invention can be run using a flushby truck, rather than requiring a service rig. Flushby trucks are normally only employed to pull the rotor out of the pump, flush the tubing with oil, and put the well back on pump. With the present invention, a flushby truck can lower the tubing with the adapter bar to pump oil down the tubing to clean out sand, then pull up the tubing to re-lock it in place to resume operation. Whereas a service rig would cost thousands of dollars and shut down operations for a day or two, after a wait of a day or two for the rig to become available, using the flushby truck costs only one-tenth of what a rig would and could perform the same task in a matter of hours rather than days.

Other advantages include the reduced need to pull production equipment to clean sand from the near well bore, total local control of the well at all times, and better utilization of the flushby units. In addition, the present invention can be used with most pumping assemblies currently available on the market.

A detailed description of an exemplary embodiment of the present invention is given in the following. It is to be understood, however, that the invention is not to be construed as limited to this embodiment.

BRIEF DESCRIPTION OF THE DRAWINGS

In the accompanying drawings, which illustrate an exemplary embodiment of the present invention.

DETAILED DESCRIPTION OF AN EXEMPLARY EMBODIMENT

Figure 1:
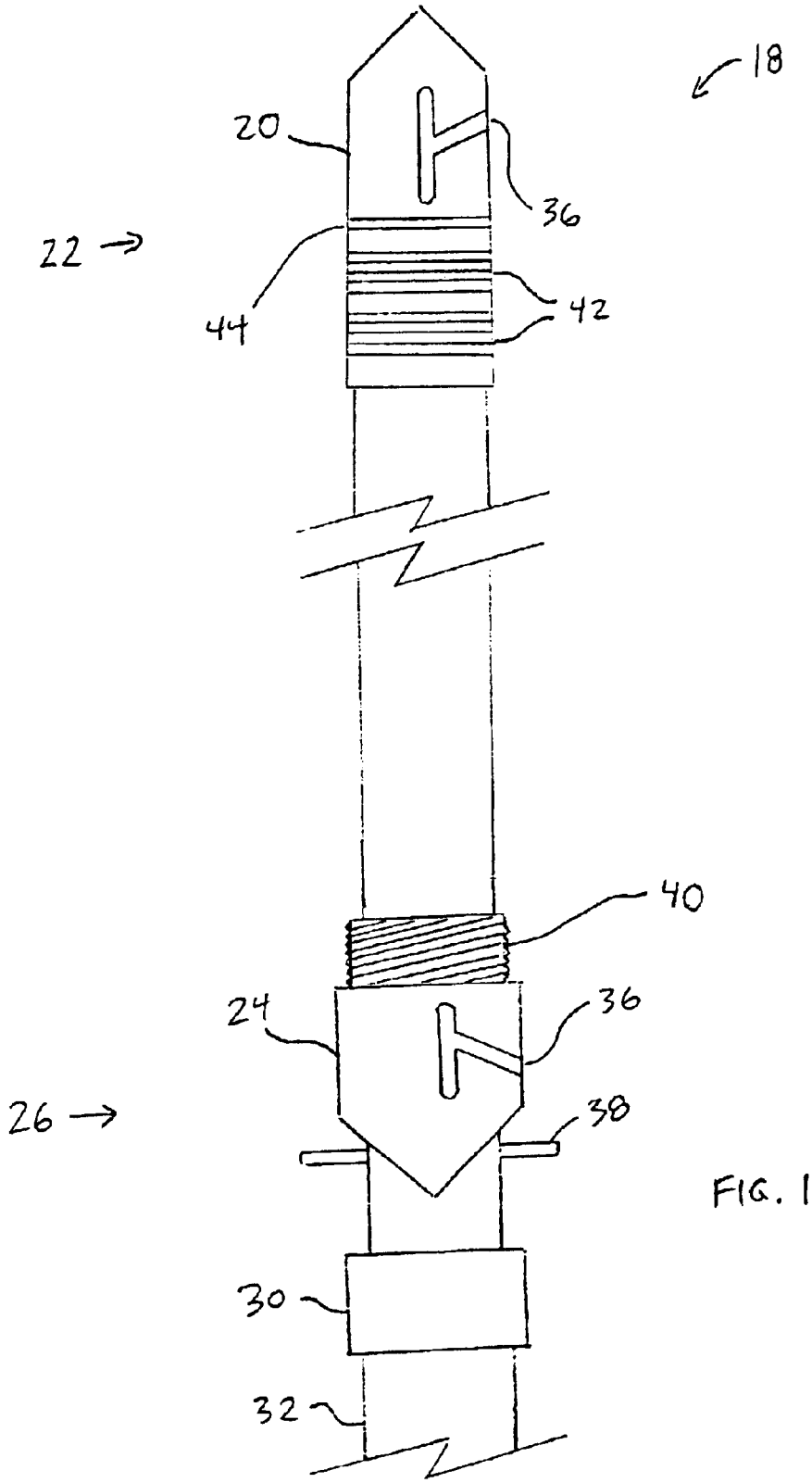
FIG. 1 is an elevational view of the present invention, including portions of the upper and lower locking means.

Referring now in detail to the accompanying drawings, there is illustrated an exemplary embodiment of the tubing joint of the present invention generally referred to by the numeral 10. The tubing joint 10 comprises a tubing hanger or dog nut 16, a barrel 12 connected to the tubing hanger 16, a tubing connector 18 for slidable insertion within the barrel 12, a lower locking means having a first lower lock component 24 secured to the barrel 12 and a second lower lock component 38 secured to the tubing connector 18 and selectively engageable with the first lower lock component 24, for suspending the tubing connector 18 and the lower tubing section 32 from the barrel 12, an adapter bar 28 for connection to a rod string 34, and an upper locking means having a first upper lock component 20 secured to an upper end 22 of the tubing connector 18 and a second upper lock component 38 secured to the adapter bar 28 and selectively engageable with the first upper lock component 20 such that with the upper locking means engaged, the adapter bar 28 may be manipulated to disengage the lower locking means so as to separate the lower tubing section 32 from the barrel 12 and suspend the tubing connector 18 and the lower tubing section 32 from the adapter bar 28. The first lower lock component 24 is slidable on the tubing connector 18 when not locked to the tubing connector 18, and it is adapted to be received by a lower end 46 of the barrel 12. The tubing joint 10 further comprises connecting means 30 at the lower end 26 of the tubing connector 18 for connecting the lower tubing section 32.

The tubing connector 18 is shown most clearly in FIG. 1, where the sub or first lower lock component 24 is shown connected to neither the lower end 46 of the barrel 12 nor the lower end 26 of the tubing connector 18. In this exemplary embodiment, the upper and lower locking means comprise jay slots 36 and corresponding pins 38. In FIG. 1, the pins 38 for the jay slots 36 of the sub 24 are on the tubing connector 18. The pins 38 for the jay slots 36 of the first upper lock component 20 are on the adapter bar 28, as can be seen in FIGS. 3 and 4.

The first upper lock component 20 is preferably threaded onto the upper end 22 of the tubing connector 18 at threaded section 40, and the sub 24 is preferably fitted with a threaded section 40 to mate with corresponding threaded section 40 at the lower end 46 of the barrel 12. The first upper lock component 20 is preferably fitted with O-rings 44 and seals 42, the seals 42 in two sets of five seals, the lowermost set directed downward against upward pressure within the well bore and the uppermost set directed upward against downward pressure. The O-rings 44 prevent sand getting on the seals.

Figure 3:
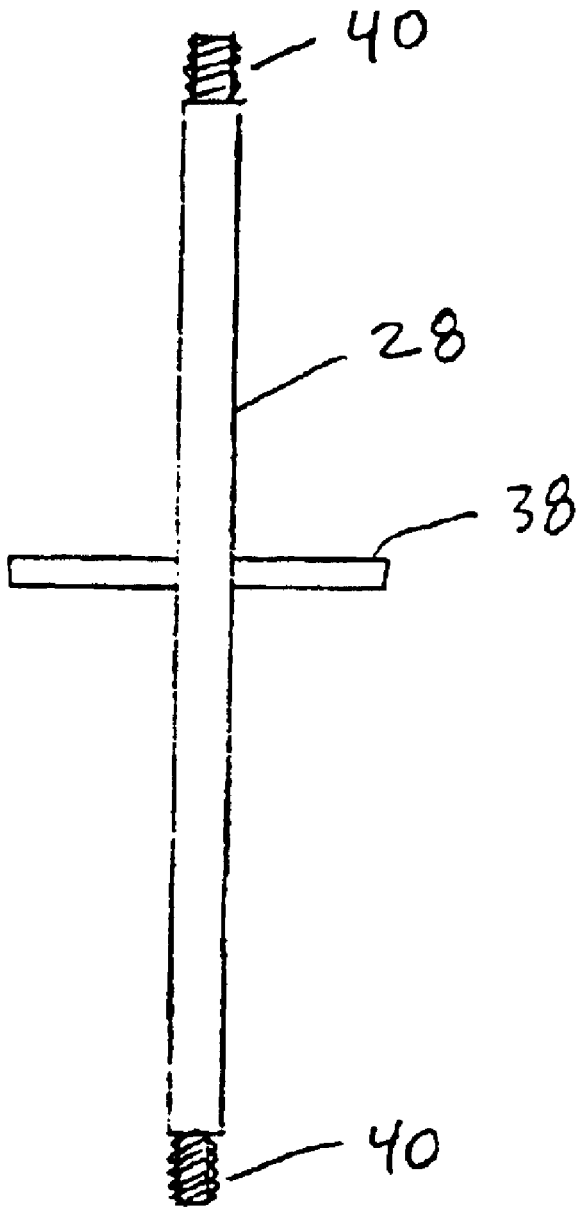
FIG. 3 is an elevational view of the adapter bar.
Figure 4:
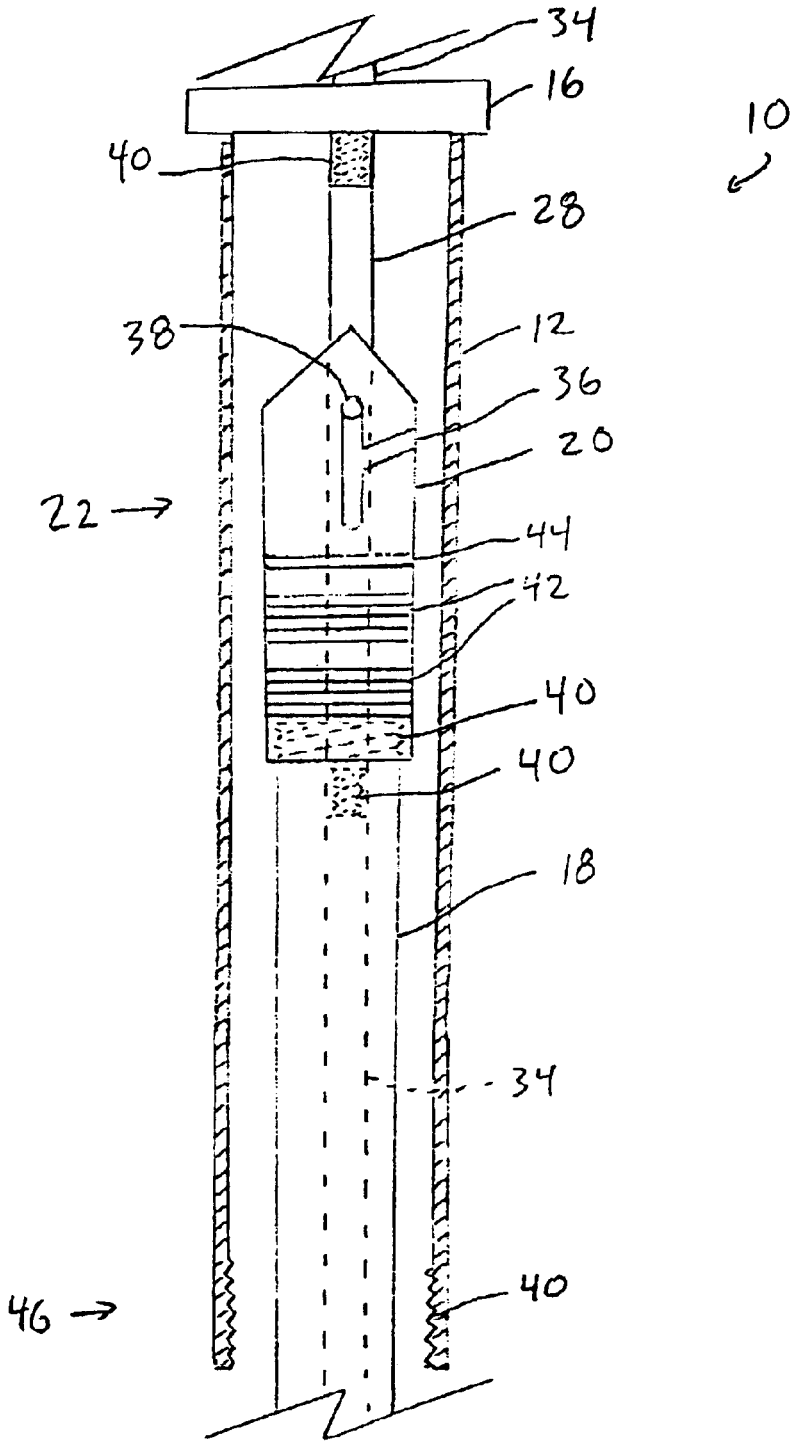
FIG. 4 is an elevational view partially in section of the adapter bar engaging the upper locking means while within the barrel.

As can be seen in FIGS. 3 and 4, the adapter bar 28 is fitted with threaded sections 40 to mate with sections of rod string 34.

Figure 2:
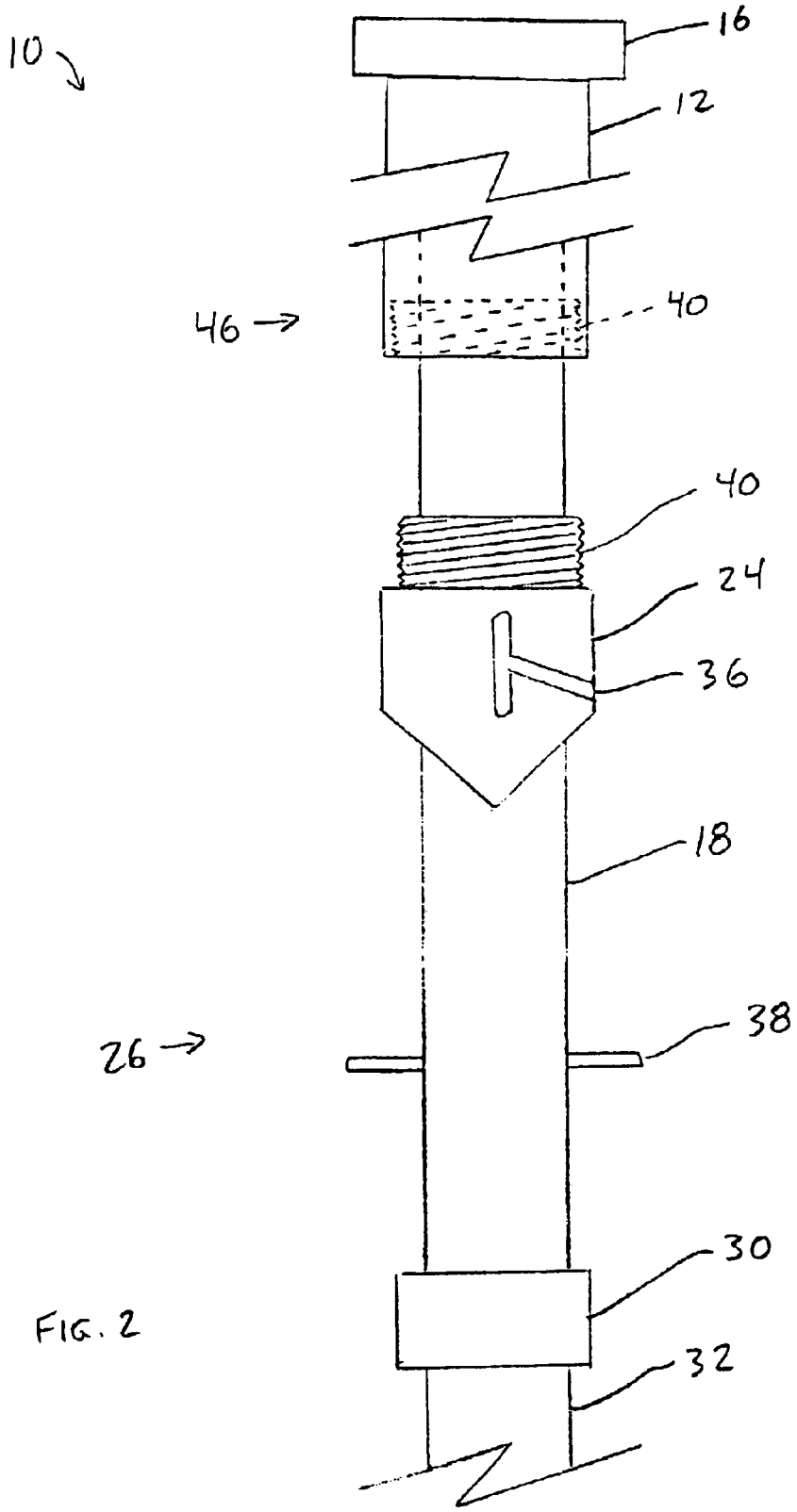
FIG. 2 is an elevational view of the tubing connector inserted within the barrel, but the sub neither received by the lower end of the barrel nor locked with the tubing connector.

The exemplary embodiment of the present invention is assembled by threading the first upper lock component 20 onto the upper end 22 of the tubing connector 18, slidably inserting the tubing connector 18 within the barrel 12 as shown in FIG. 2, threading the sub 24 into the threaded section 40 of the lower end 46 of the barrel 12, inserting the adapter bar 28 within the tubing connector 18, engaging the pins 38 in the jay slots 36 of the first upper lock component 20 as shown in FIG. 4, pulling up on the adapter bar 28 to raise the tubing connector 18, and locking the sub 24 to the tubing connector 18 by rotating in a first direction the adapter bar 28 such that the pins 38 on the tubing connector 18 engage the jay slots 36 of the sub 24. The adapter bar 28 is then pulled free of the barrel 12 and removed from the rod string 34, the rod string 34 sections then reconnected to each other. The connecting means 30 can be connected to a lower tubing section 32, with possibly fifty or sixty sections of tubing and a stator or oil pump below this (not shown), and the barrel 12 is inserted within a well bore (not shown). The rod string 34 is then set to turn and the pumping begins.

The utility of the present invention then becomes clear in the following situation. When sand is detected in the well bore and hampers proper well operation, pumping is shut down and the well head disassembled. However, the tubing hanger or dog nut 16 is not unseated. A flushby unit (not shown) is moved over the well bore and unseats the rotor (not shown) from the stator (not shown). The flushby unit performs a clean oil flush through the tubing all the way to the bottom of the well bore, cleaning out the interior of the system. The flushby unit then extracts part of the rod string 34 and the top well head drive (not shown) is removed. The adapter bar 28 is inserted between two sections of the rod string 34 at threaded sections 40. The adapter bar 28 is then lowered into the barrel 12 and tubing connector 18, where its pins 38 engage the corresponding jay slots 36 of the first upper lock component 20. Rotation of the rod string 34 in a second direction then unlocks the sub 24 from the tubing connector 18, and the rod string 34 can then be lowered along with the tubing connector 18, while flushing oil at the same time, cleaning out sand build-up as it is lowered. After the well bore bottom is reached, the rod string 34 is pulled up, the sub 24 is re-locked with the tubing connector 18, the rod string 34 is rotated in a second direction to disengage the pins 38 of the adapter bar 28 from the jay slots 36 of the first upper lock component 20, and the rod string 34 is pulled up to allow removal of the adapter bar 28. As stated above, the adapter bar 28 can be removed from the rod string 34 or left in place after use in disengaging and re-engaging the lower locking means. The well head can then be reassembled and the well is then ready to be put back on pump, and the entire process has taken only a fraction of the time required for service rig operation, at a fraction of the cost.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the appended claims.

Embodiments of the invention in which an exclusive property or privilege is claimed are defined as follows:

1. A tubing joint for a well including a well bore, a well head at the top of the well bore, and a production tubing string extending along the well bore from the well head, the tubing joint comprising:

a tubing hanger suspending the production tubing string from the well head;

a barrel forming an upper tubing section of the production tubing string and connected to the tubing hanger;

a tubing connector within the barrel and having a lower end connected to a lower tubing section of the production tubing string;

a lower locking means having:

a first lower lock component secured to the barrel; and a second lower lock component secured to the tubing connector and selectively engageable with the first lower lock component, for suspending the tubing connector and the lower tubing section from the barrel;

an adapter bar for connection to a rod string; and an upper locking means having:

a first upper lock component secured to the tubing connector; and a second upper lock component secured to the adapter bar and selectively engageable with the first upper lock component such that with the upper locking means engaged, the adapter bar may be manipulated to disengage the lower locking means so as to separate the lower tubing section from the barrel and suspend the tubing connector and the lower tubing section from the adapter bar.

2. A well including a tubing joint according to claim 1 and further including a downhole pump connected to the production tubing string and the rod string along the production tubing string for driving the downhole pump, the adapter bar being adapted for insertion between an upper portion of the rod string and a lower portion of the rod string.

3. The invention according to claim 1 wherein the lower locking means comprise:

a sub connected to the barrel;

a slot in the sub with an upwardly inclined entrance section and an axial locking section; and a pin secured to and projecting laterally from the tubing connector and engageable in the slot.

4. The invention according to claim 1 wherein the upper locking means comprise:

a slot in the tubing connector with a downwardly inclined entrance section and an axial locking section; and a pin secured to and projecting laterally from the adapter bar and engageable in the slot.

5. A method of flushing a well including a well bore, a well head at the top of the well bore, and a production tubing string extending along the well bore from the well head comprising the steps of:

(a) providing a tubing joint in the production tubing string;

(b) inserting a rod string including an adapter bar into the production tubing string;

(c) attaching the adapter bar to the tubing joint;

(d) manipulating the adapter bar to manipulate the tubing joint and separate the production tubing string into an upper tubing section suspended from the well head and a lower tubing section suspended from the adapter bar;

(e) flushing the production tubing string and the well bore; and (f) manipulating the adapter bar to manipulate the tubing joint and reconnect the upper tubing section suspended from the well head and the lower tubing section suspended from the adapter bar.

6. A method according to claim 5 wherein the well includes a downhole pump connected to the production tubing string and the rod string along the production tubing string for driving the downhole pump, and including the steps of pulling the rod string and inserting the adapter bar between an upper portion of the rod string and a lower portion of the rod string before the step of inserting the rod string into the production tubing string.

7. A method according to claim 5 including lowering the rod string during the flushing of the production tubing string and the well bore.

8. A method according to claim 6 including lowering the rod string during the flushing of the production tubing string and the well bore.

* * * * *